US007121657B2

(12) United States Patent
Nagasaki et al.

(10) Patent No.: US 7,121,657 B2
(45) Date of Patent: Oct. 17, 2006

(54) INK CARTRIDGE FOR INKJET RECORDING APPARATUS

(75) Inventors: Mitsuru Nagasaki, Choufu (JP); Takashi Konishi, Sagamihara (JP)

(73) Assignee: Konica Minolta Medical & Graphic, Inc., Tokyo (JP)

( * ) Notice: Subject to any disclaimer, the term of this patent is extended or adjusted under 35 U.S.C. 154(b) by 0 days.

(21) Appl. No.: 11/202,865

(22) Filed: Aug. 12, 2005

(65) Prior Publication Data

US 2006/0038865 A1 Feb. 23, 2006

(30) Foreign Application Priority Data

Aug. 20, 2004 (JP) ..... 2004-240555

(51) Int. Cl.
*B41J 2/175* (2006.01)

(52) U.S. Cl. ..... 347/86

(58) Field of Classification Search ..... 347/85, 347/86, 87

See application file for complete search history.

(56) References Cited

U.S. PATENT DOCUMENTS 6,325,500 B1 * 12/2001 Kitabatake et al. ..... 347/86
6,758,556 B1 * 7/2004 Ishizawa et al. ..... 347/86

FOREIGN PATENT DOCUMENTS

| | | | |
|---|---|---|---|
| JP | 07-323559 | A | 12/1995 |
| JP | 2002-331684 | A | 11/2002 |
| JP | 2002-347257 | A | 12/2002 |
| JP | 2003-145785 | A | 5/2003 |
| JP | 2003-226023 | A | 8/2003 |

* cited by examiner

*Primary Examiner*—K. Feggins
(74) *Attorney, Agent, or Firm*—Frishauf, Holtz, Goodman & Chick, P.C.

(57) ABSTRACT

An ink cartridge used in an inkjet recording apparatus, including and ink storing section having an ink outlet section, and an outer case, wherein the outer case includes a casing section to store the ink storing section, a positioning member to secure the ink outlet section, a first cushioning member to support a top of the ink storing section, a second cushioning member to support a bottom of the ink storing section, and a securing member to secure at least a part of the ink storing section onto the outer case.

19 Claims, 6 Drawing Sheets

FIG. 2 ( a )
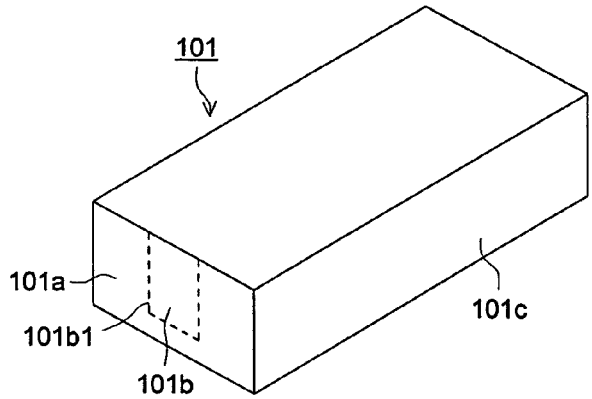
FIG. 2 ( b )
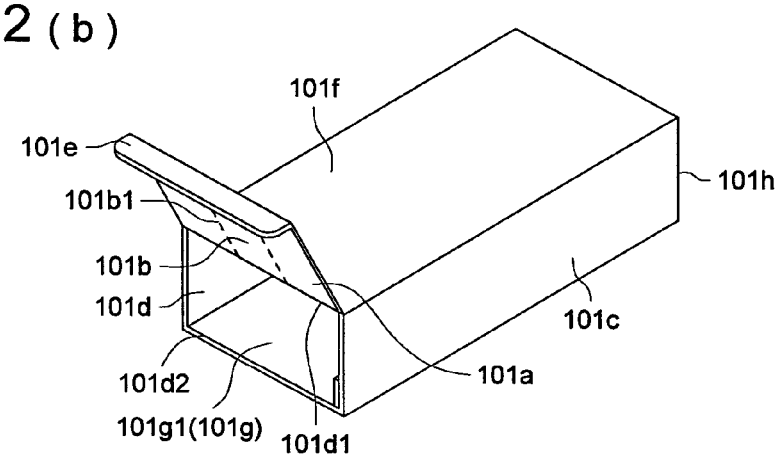
FIG. 2 ( c )
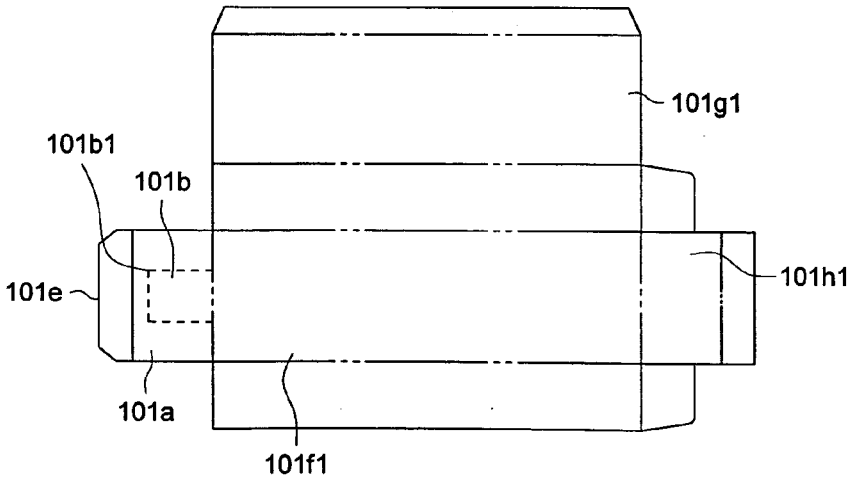

FIG. 3 ( a )
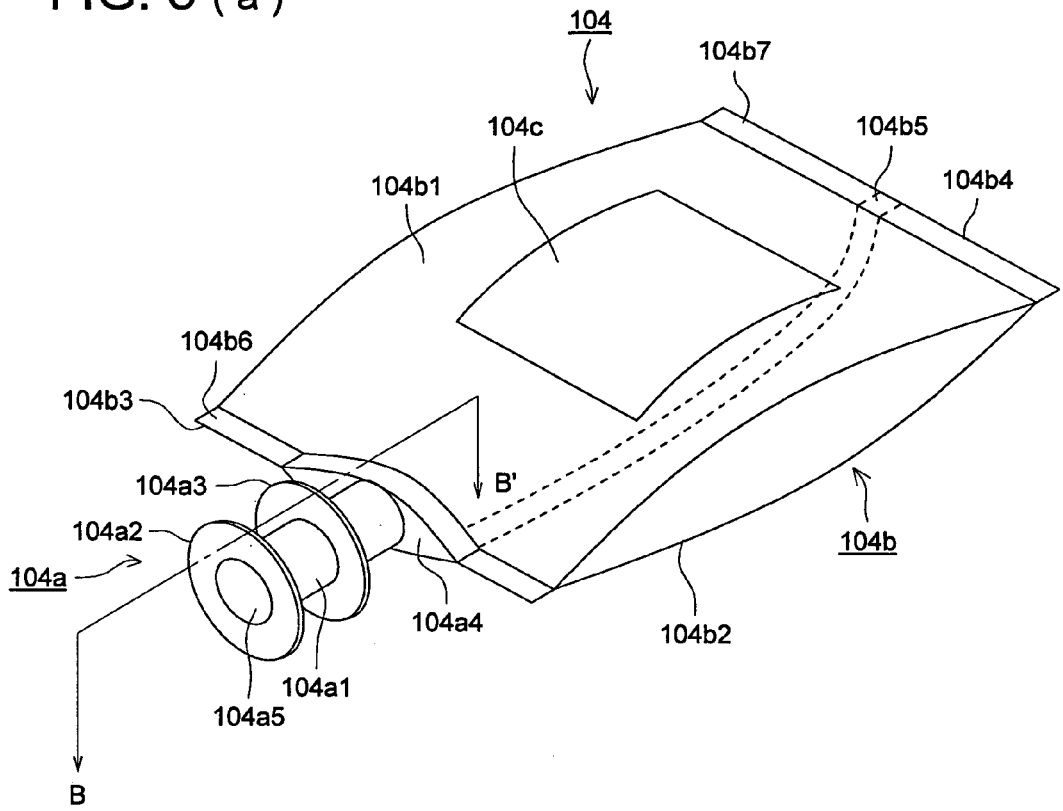
FIG. 3 ( b )
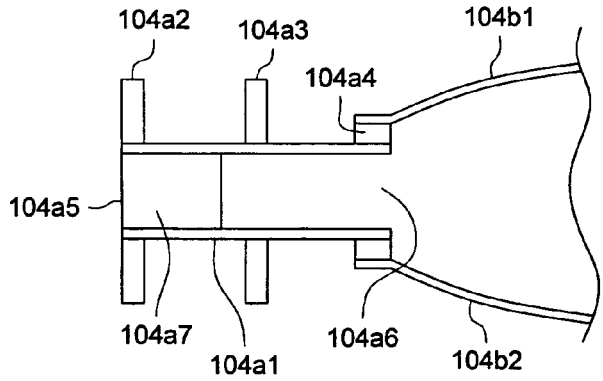

FIG. 4 ( a )
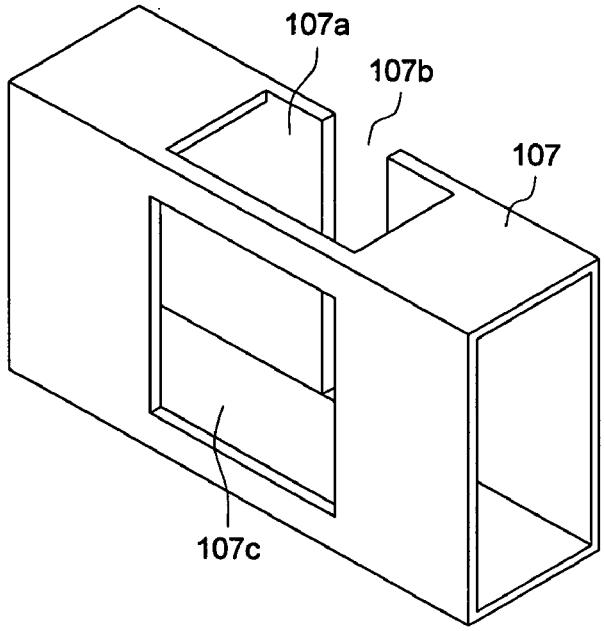
FIG. 4 ( b )
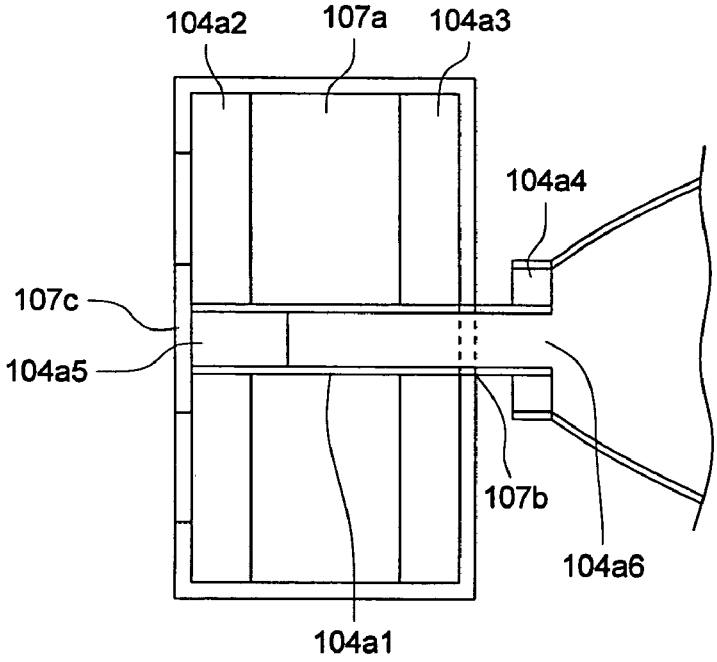

INK CARTRIDGE FOR INKJET RECORDING APPARATUS

This application is based on Japanese Patent Application No. 2004-240555 filed on Aug. 20, 2004 in the Japanese Patent Office, the entire content of which is hereby incorporated by reference.

BACKGROUND OF THE INVENTION

The present invention relates to an ink cartridge which accommodates an ink container incorporating an ink outlet section and an ink storing section, which is used for the inkjet recording apparatus.

In recent years, digital devices have shown rapid progress, and in order to visually print out information outputted from the digital devices, inkjet printers are requested to produce more exquisite output, meeting the progress of the digital devices, and further, the image size produced by the inkjet printer is also required to be larger. In an inkjet recording device (printer), an ink cartridge is used to supply ink to a recording head, and an ink cartridge is provided with an ink container which incorporates an ink outlet section and an ink storing section.

Due to larger printed images, the amount of ink consumption is increased. Further, due to larger dimensions of the ink storing section, the ink storing section and the ink outlet section, formed of multilayer materials in which various laminated thermoplastic resin films are used, are advantageous in productivity and production cost. The functions described below are required of an ink cartridge used in inkjet recording device.

(1) In order that the inkjet recording device can stably produce text and picture images on a recording sheet, required is that the ink storing section of the ink container can secure the desired characteristics of ink, such as viscosity and surface tension, over the long term.

(2) Generation of air bubbles must be prevented in ink flow path from the ink container to the recording head, and blockage of ink flow caused by foreign substances must be prevented.

(3) The ink cartridge must be easily loaded into and removed from the inkjet recording device.

Concerning means to achieve the above described requirements, multiplayer film materials are used for the ink storing section of the ink container, which is disclosed in Unexamined Japanese Patent Application Publications JP-A 54-151033, JP-A 56-44669, JP-A 54-151033, JP-A 56-44669, JP-A 62-121062 and JP-A 7-323559.

In ink storing sections having the above means, an ink storing section formed of the multiplayer film materials is commonly used due to increased productivity and lower cost, however they exhibit some drawbacks described below.

(1) Due to occasional dropping and vibration of the ink cartridge during transportation and handling, the ink container in the ink cartridge is displaced, which results in bending of the ink storing section, pin holes are generated on the bent section, and further, the bent section grinds against the inner surfaces of the ink cartridge, resulting in generation of pin holes, and further, the ink outlet section may be displaced from the ink storing section.

(2) While the operation of the inkjet recording device loading the above ink cartridge, when the amount of the ink is reduced, the ink storing section is deformed and its capacity is also reduced, and thereby, some creases are generated, in which ink is trapped.

As countermeasure for the above problems, for examples, an flexible ink container bag is used which incorporates an ink outlet section and the ink storing section, formed of soft multiplayer film material. In order to reduce remaining ink, disclosed is an ink cartridge wherein a pressing member is mounted on the ink storing section, incorporating an ink outlet section in which an ink supplying pin can be inserted, when the ink cartridge is loaded onto the inkjet recording device (Patent Document 1). However, according to the ink cartridge of Patent Document 1, the mounted pressing member may be dislocated by dropping or vibration during transportation, further, when the ink amount is reduced during operation of the inkjet recording device, the ink storing section may be deformed, and if the deformation is a wrong shape, much ink may remain, which is a problem. Further, since the ink outlet section and the ink storing section are not fixed, when the ink cartridge is loaded into the inkjet recording device, positioning of the ink outlet section requires a relatively long time, that is, exchanging ink cartridges takes a relatively long time.

An ink cartridge is well known wherein a buffer materials protect an ink container as a bag, incorporating an ink outlet section and an ink storing section, formed of soft multi-layer film materials, whereby most damage of the ink container is prevented, such as dropping during the transportation and the handling, or by vibration during the transportation (Patent Document 2). However, in the case of the ink cartridge of Patent Document 2, since the cushioning material covers the ink container, when only a little ink remains, clearance is generated between the buffer materials and the ink storing section, and if the deformation of the ink storing section causes ink blockage, the amount of remaining ink can be quite very large, which is wasteful, and further, it requires time and material to produce the ink cartridge, resulting in wasteful productivity.

Also well known is an ink cartridge, wherein an ink container being a bag or pouch, incorporating an ink outlet section and an ink storing section, formed of soft multi-layer film material, is pressed by a pressing means, so that any the remaining ink can be decreased (Patent Document 3). However, in the case of the ink cartridge of Patent Document 3, the ink storing section must be inserted within the pressing means, which is time consuming in terms of workability when the cartridge is loaded.

Also well known is an ink cartridge, wherein reinforcing materials are provided on the upper surface and the lower surface of an ink container being a bag or pouch, incorporating an ink outlet section and an ink storing section, formed of the soft multi-layer film material, so that the remaining ink can be decreased (Patent Document 4). However, in the case of the ink cartridge of Patent Document 4, when the amount of ink is reduced, clearance is generated between the reinforcing materials and the ink storing section, whereby, if the deformation of the ink storing section is severe, the amount of remaining ink can be very large. When the ink cartridge is loaded into the inkjet recording device, the direction of the ink outlet section is limited, resulting in poor versatility. Due to the above conditions, concerning an inkjet cartridge, incorporating the ink outlet section and the ink storing section with less remaining ink, an inkjet cartridge is strongly required to be developed which is easily mounted into or dismounted from the inkjet recording device, and not effected by dropping during transportation or handling, nor by vibration during transportation.

[Patent Document 1] JP-A 2002-347257

[Patent Document 2] JP-A 2002-331684

[Patent Document 3] JP-A 2003-226023

[Patent Document 4] JP-A 2003-145785

SUMMARY OF THE INVENTION

The present invention has been achieved based on the above conditions, and the objective is to provide an inkjet cartridge being a bag or pouch which accommodates an ink container incorporating an ink outlet section and an ink storing section, wherein the ink cartridge is easily loaded into and removed from the inkjet recording device, not being effected by dropping during transportation and handling, nor by vibration during transportation.

The above-described objective was attained by the structures described below.

Structure 1

In an ink cartridge used in an inkjet recording device, including an outer case having a rectangular cross section, the outer case accommodates an ink package incorporating an ink outlet section formed of thermoplastic resin and an ink storing section being a bag formed of multi-layer thermoplastic film material, the outer case includes:

a main case having a rectangular open section, a lid attached onto the rectangular open section, and a positioning member attached into the rectangular open section;

wherein the ink package is supported in the main case while the ink storing section is supported by a first cushioning member and a second cushioning member, the ink package is housed in the main case while the ink outlet section is inserted into the positioning member, one of the outer surfaces of the ink storing section is fixed onto the inner surface of the main case by a fixing means, and the lid is fixed onto the main case by a sealing means.

Structure 2

The ink cartridge used in an inkjet recording device in Structure 1, wherein the first cushioning member includes paired cushioning members A and B, cushioning member A which is an outlet side cushioning member includes:

vertical surface X contacting the rear surface of the positioning member;

horizontal surface Y contacting a first inner surface including the longer edge of the rectangular open section of the main case; and slanted surface Z contacting surface "a" including a shorter edge of the ink storing section; and cushioning member B which is an opposite side cushioning member includes:

vertical surface X contacting an inner surface facing the rectangular open section of the main case;

horizontal surface Y contacting the first inner surface; and slanted surface Z contacting surface "a".

Structure 3

The ink cartridge used in an inkjet recording device in Structure 1 or 2, wherein the cross sections of the paired cushioning members A and B of the first cushioning member are triangular.

Structure 4

The ink cartridge used in an inkjet recording device in any one of Structures 1–3, wherein cushioning member A and cushioning member B are connected by a flat member which is parallel to the first inner surface including the longer edge of the rectangular open section of the main case.

Structure 5

The ink cartridge used in an inkjet recording device in any one of Structures 1–4, wherein cushioning member A and cushioning member B are independent of each other.

Structure 6

The ink cartridge used in an inkjet recording device in any one of Structures 1–5, wherein the second cushioning member includes paired cushioning members C and D, the cushioning member C which is an outlet side cushioning member includes:

vertical surface X being in contact with the rear surface of the positioning member;

horizontal surface Y being in contact with a second inner surface including the longer edge of the rectangular open section of the main case; and slanted surface Z being in contact with surface "b" including the shorter edge of the ink storing section; and cushioning member D which is an opposite side cushioning member includes:

vertical surface X being in contact with an inner surface facing the rectangular open section of the main case;

horizontal surface Y being in contact with a second inner surface including the longer edge of the rectangular open section of the main case; and slanted surface Z being in contact with the surface "b" including the shorter edge of the ink storing section.

Structure 7

The ink cartridge used in an inkjet recording device in any one of Structures 1–6, wherein the cross sections of paired cushioning members C and D of the second cushioning member are triangular.

Structure 8

The ink cartridge used in an inkjet recording device in any one of Structures 1–7, wherein cushioning member C and cushioning member D are united by a flat member which is parallel to the second inner surface including the longer edge of the rectangular open section of the main case.

Structure 9

The ink cartridge used for an inkjet recording device in any one of Structures 1–8, wherein cushioning member C and cushioning member D are independent of each other.

Structure 10

The ink cartridge used in an inkjet recording device in any one of Structures 2–9, wherein in view of the cushioning member A, angle θ1 of 68–84° is formed by connecting surface X being in contact with the rear surface of the positioning member, and slanted surface Z being in contact with the "a" surface including a shorter edge of the ink outlet section of the ink package, and further, angle θ2 of 7–22° is formed by horizontal surface Y being in contact with the first inner surface including the longer edge of the rectangular open section of the main case, and slanted surface Z being in contact with the "a" surface including the shorter edge of the ink outlet section of the ink package.

Structure 11

The ink cartridge used in an inkjet recording device in any one of Structures 2–10, wherein in view of cushioning member B, angle θ3 of 68–84° is formed by connecting surface X being in contact with the inner surface facing the rectangular open section of the main case, and slanted surface Z being in contact with the "a" surface including the shorter edge of the ink storing section facing the ink outlet section of the ink package, and further, angle θ4 of 7–22° is formed by horizontal surface Y being in contact with the first inner surface including the longer edge of the rectangular open section of the main case, and slanted surface Z being in contact with the "a" surface including the shorter edge of the ink storing section facing the ink outlet section of the ink package.

Structure 12

The ink cartridge used in an inkjet recording device in any one of Structures 2–11, wherein the cross-section of cushioning member C is the same as the cross-section of cushioning member D.

Structure 13

The ink cartridge used in an inkjet recording device in any one of Structures 2–12, wherein the cross-section of cushioning member D is the same as the cross-section of cushioning member B.

Structure 14

The ink cartridge used in an inkjet recording device in any one of Structures 1–13, wherein rigidity of the multi-layer thermoplastic film material is $9.7\times10^{-7}$–$9\times10^{-6}$ $Nm^2$.

Structure 15

The ink cartridge used in an inkjet recording device in any one of Structures 1–14, wherein the lid includes a cut-out section at a position corresponding to the ink outlet section.

Structure 16

The ink cartridge used in an inkjet recording device in any one of Structures 1–15, wherein ink which is stored in the ink storing section is an ultraviolet hardening type ink.

Structure 17

The ink cartridge used for an inkjet recording device in any one of Structures 1–16, wherein the outer case, the positioning member, the first cushioning member and the second cushioning member are formed of a paper material.

Structure 18

The ink cartridge used for an inkjet recording device in any one of structures 1–17, wherein the outer case, the positioning member, the first cushioning member and the second cushioning member are formed of the same resin material.

BRIEF DESCRIPTION OF THE DRAWINGS

FIGS. 2(*a*)–(*c*) are schematic views of the outer case shown in FIG. 1.

FIGS. 3(*a*) and (*b*) are enlarged schematic views of the ink package shown in FIG. 1.

FIGS. 4(*a*) and (*b*) are enlargement of the positioning member shown in FIG. 1.

DETAILED DESCRIPTION OF THE PREFERRED EMBODIMENT

The embodiments of the present invention will now be explained referring to FIGS. 1–6, however this invention is not limited to them.

Figure 1:
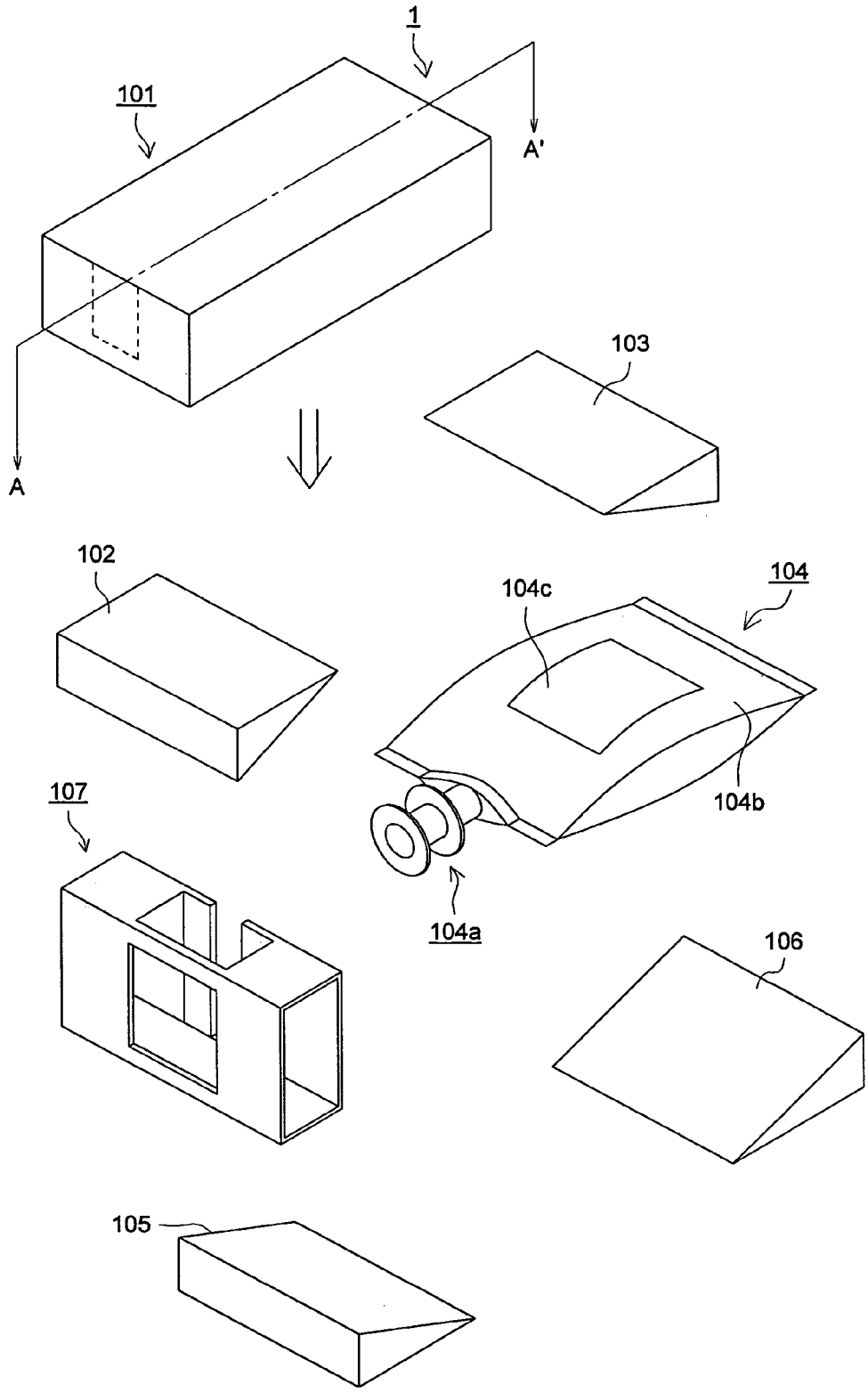
FIG. 1 is an exploded schematic perspective view of the ink cartridge.

FIG. 1 is a schematic perspective view of the ink cartridge.

In FIG. 1, numeral 1 is an ink cartridge. Ink cartridge 1 incorporates outer case 101, paired A-type cushioning member 102 and B-type cushioning member 103, which are first cushioning members, ink package 104 including ink outlet section 104*a* and ink storing section 104*b*, paired C-type cushioning member 105 and D-type cushioning member 106, which are second cushioning members, and positioning member 107 to positively position ink outlet section 104*a*.

Numeral 104*c* is a double faced adhesive tape which secures either surface of ink storing section 104*b* to an inner surface of outer case 101, when ink package 104 is placed in outer case 101. Next, each member structuring the ink cartridge shown in FIG. 1 will be respectively detailed referring to FIGS. 2–6.

FIGS. 2(*a*)–(*c*) are schematic views of outer case 101 shown in FIG. 1. FIG. 2(*a*) is a schematic perspective view of outer case 101. FIG. 2(*b*) is a schematic perspective view of outer case 101 whose hinged end section is open. FIG. 2(*c*) is an unfolded view of outer case 101, showing the interior.

Outer case 101 incorporates main case 101*c* having rectangular opening 101*d*, and lid 101*a* hinged on one edge of opening 101*d* via a crease. Numeral 101*b* is a perforated tab. Numeral 101*b*1 shows perforated lines to easily tear off tab 101*b* from lid 101*a*. Numeral 101*e*, as a hinged flap provided on lid 101*a*, fixes lid 101*a* onto main case 101*c*. Adhesive tape can also be used to fix lid 101*a* onto main case 101*c*. Positioning member 107 can be attached into opening 101*d* (see FIG. 1).

Numeral 101*f*1 in FIG. 2(*c*) shows a first inner surface of surface 101*f* of main case 10*c* which has longer edge 101*d*1 of opening 101*d*.

Numeral 101*g*1 shows the second inner surface of surface 101*g* which has longer edge 101*d*2 of opening 101*d*. Numeral 101*h*1 shows the inner surface of surface 101*h* facing opening 101*d*. Outer case 101 is assembled via folding each section on the fold lines, and fixing the flap, based on the expansion plan shown in FIG. 2(*c*).

The shape of the outer case is not particularly limited, for example, the one described in JIS Z1507, as well as the one described on pages 821–824 of "Manual of the Newest Sheet Process" issued by Tec Times Co., can also be used. Outer case 101 shown in FIG. 2(*c*) is produced of a single sheet. In addition, the shape of the main case to store the ink storing section is not particularly limited, however, a cuboid is preferable from the view point of transportation and storage.

Concerning the material for outer case 101, paper materials, such as paperboard, corrugated fiberboard, and thermoplastic resin, sheet material all of which are commonly used for box production, can be used, and the paper material is preferable from the point of view of the reduction of environmental load. When using paper material, outer case 101 can be produced of a white lined paper board or corrugated fiberboard which are general paperboard described in "Manual of the Newest Sheet Process" issued by Tec Times Co. Paperboard at a basic weight of 300–700 $g/m^2$ is preferable, and more preferable is 400–600 $g/m^2$. Less than 300 $g/m^2$ may provide insufficient strength for handling or transportation. Greater than 700 $g/m^2$ may be unsuitable for the production of the outer case, or would result in an increase of environmental load. A paperboard thickness of 260–1140 μm is preferable, however 480–920 μm is more preferable. Less than 260 μm may provide insufficient strength for handling or transportation, while greater than 1140 μm would result in an increase of environmental load.

As corrugated fiberboard, a double faced corrugated fiberboard of "A flute"–"E flute", or a double wall corrugated fiberboard, which are common, are preferably used, but there is no specific limitation, and can be selected based on the overall size of the ink container.

On the surface of the ink cartridge of the present invention, identifying markings of the contents are displayed, which can be directly printed on the surface of the cartridge, or a label identifying the contents can be adhered.

FIGS. 3(*a*) and 3(*b*) are enlarged views of the ink package shown in FIG. 1. FIG. 3(*a*) is an enlarged perspective view of the ink package shown in FIG. 1, while FIG. 3(*b*) is a cross-section of the ink package taken along line B–B' in FIG. 3(*a*).

In FIG. 3(*a*), numeral 104*b*1 shows surface "a" [being an upper surface in FIG. 3(*a*)] of the thermoplastic film, forming ink storing section 104*b*, and surface "a" is the surface having shorter edges 104*b*3 and 104*b*4 of ink storing section 104*b*. Numeral 104*b*2 shows surface "b", being a lower surface in FIG. 3(*a*), which is made of the thermoplastic film, forming ink storing section 104*b*, and further surface "b" also has shorter edges 104*b*3 and 104*b*4 of ink storing section 104*b*, that is, surface "b" 104*b*2 faces surface "a" 104*b*1.

Numeral 104*b*5 shows a sealed center section which forms sealed ink storing section 104*b*, being a bag, while numeral 104*b*7 shows another sealed section for forming sealed ink storing section 104*b*. The structure of ink storing section 104*b* is not limited, for example, three edges of two overlapped sheets of thermoplastic films can be sealed as a bag, or a sheet of thermoplastic film can be folded and two of the three edges are sealed to form a bag. FIG. 3(*a*) shows that a sheet of thermoplastic film is folded and two edges are sealed as a bag, that is, ink storing section 104*b* is formed by a so-called center sealing method, in which the seal is positioned on the longitudinal center of the bag. Numeral 104*b*6 shows a sealed section in which joining member 104*a*4 of ink outlet section is integrally joined to ink storing section 104*b*. To join ink storing section 104*b* to joining member 104*a*4, after joining member 104*a*4 is inserted into ink storing section 104*b*, liquid tight seal is conducted via heat adhesion or an adhesive agent. Numeral 104*c* shows a double-faced adhesive tape being a fixing means which secures either surface "a" 104*b*1 or surface "b" 104*b*2 of ink storing section 104*b* onto the interior surface of the outer case 101. FIG. 3(*a*) further shows that double-faced tape 104*c* is adhered on surface "a" 104*b*1. An adhesive agent can also be used in stead of tape, whereby either surface "a" 104*b*1 or surface "b" 104*b*2 of ink storing section 104*b* is fixed onto the interior surface of the outer case 101. In stead of double-faced tape 104*c*, a clip can also be used which catches the end of storing section 104*b*, or a cushioning member can secure storing section 104*b*.

Ink outlet section 104*a* includes ink outlet tube 104*a*1, flange member 104*a*2 attached at the extreme outer end of ink outlet tube 104*a*1, joining member 104*a*4 which is attached on the interior end of ink outlet tube 104*a*1 to join it into ink storing section, and flange member 104*a*3 which is located between joining member 104*a*4 and flange member 104*a*2. Clearance between flange member 104*a*2 and flange member 104*a*3 can be determined based on the width of storing section 107*a* of positioning member 107 [see FIG. 4(*b*)]. By locating flange member 104*a*2 and flange member 104*a*3 into storing section 107*a*, ink outlet section 104*a* is positioned adequately and secured.

Numeral 104*a*5 is an opening of ink outlet tube 104*a*1 into which the ink supplying means of the inkjet recording device is inserted, while numeral 104*a*6 is the opposed opening which faces ink storing section 104*b*. Numeral 104*a*7 is a sealing-up member which opens ink outlet tube 104*a*1, when the ink supplying means of the inkjet recording device is inserted, and which seals ink outlet tube 104*a*1, when the ink supplying means is removed.

Listed as sealing member 104*a*7 are common natural rubber, synthetic rubber, and thermoplastic resins. Employed as the synthetic rubber may, for example, be styrene-butadiene rubber, isoprene rubber, butyl rubber, urethane rubber, silicone rubber (polydimethylolsiloxane), vinyl silicone rubber, phenyl silicone rubber, and fluorinated silicone rubber.

The method of fixing sealing-up member 104*a*7 into ink outlet tube 104*a*1 is not specially limited, and the following methods may be used. For example, (1) In the case that sealing-up member 104*a*7 and ink outlet tube 104*a*1 are an integrated material, sealing-up member 104*a*7 and ink outlet tube 104*a*1 are formed of polyethylene, being a thermoplastic resin, by integrated injection molding. (2) In the case that sealing-up member 104*a*7 and ink outlet tube 104*a*1 are independent parts, both parts are fixed to each other via an adhesive agent, or an engaging section is provided for sealing.

The thickness of joining member 104*a*4 is preferably 1–6 mm, and more preferably 2–5 mm, from the view point of the intensity and remaining ink. The diameter of ink outlet tube 104*a*1 is based on the girth of the ink supplying means of the inkjet recording device, and also on the thickness of joining member 104*a*4. When ink outlet section is provided, ink storing section 104*b* sealed to joining member 104*a*4 is tightly joined. Accordingly, grooves are preferably provided on the upper and lower surfaces of joining member 104*a*4. It is necessary to determine the outer diameter of ink outlet tube 104*a*1, based on the thickness of joining member 104*a*4 incorporating grooves.

The ink package in FIG. 3(*a*) can be produced by the method described below. After an ink storing section having two openings as a cam type is formed of the multi-layer thermoplastic film, ink outlet section 104*a* is attached on one of the openings. Next, ink is filled in it from the other opening under reduced pressure, and the opening is sealed via heat adhesion or an adhesive agent. The ink storing section as a cam type can be formed by any of the following methods. (1) The long edges of two superposed rectangular multi-layer thermoplastic sheets of film are adhered via heat adhesion or an adhesive agent. (2) A rectangular multi-layer thermoplastic sheet of film is folded at its longitudinal center, and the superposed edges parallel to the folded edge are adhered via heat adhesion or an adhesive agent. (3) A rectangular multi-layer thermoplastic sheet of film is folded at its lateral center, and the superposed edges parallel to the folded edge are adhered via heat adhesion or an adhesive agent. The easiest method will obviously be chosen and used for production.

As a method of attaching the ink outlet section into a sack body, after the joining member which was fixed onto the ink outlet tube of the ink outlet section is inserted into the ink storing section, heat adhesion or adhesive adhesion is conducted, and thereby the ink package is completed. Additionally, the end on which ink outlet section 104*a* is located, is referred to as the top end of the ink storing section, while the opposite side is referred to as the bottom end.

Materials employed for ink feeding section 104*a* are not particularly limited. From the aspect of cost as well as ease of production, it is most preferable to use thermoplastic resins. It is possible to produce them employing very common methods such as ejection molding methods described in Jitsuyo Plastic Seikei Kako Binran (Practical Plastic Molding Machining Handbook), edited by Zen-Nihon Plastic Seikei Kogyo Rengo Kai. The used thermoplastic resins are not particularly limited as long as they can be subjected to ejection molding. For example employed may be common resins such as polyethylene, polystyrene, polyamide, polyacetal, polycarbonate, or polypropylene.

Preferred as a thermoplastic film employed in an ink loading section is a multilayered thermoplastic film. In view of 1) oxygen permeability, 2) bonding strength with the bonding section of the ink feeding section, and 3) handling properties, stiffness of the multilayered thermoplastic film used in the present invention is preferably $7.9\times10^{-7}$–$1.9\times10^{-6}$ $Nm^2$, but is more preferably $6.7\times10^{-7}$–$3.1\times10^{-6}$ $Nm^2$.

To maintain the preferred stiffness range as described above and considering 1) strength as an ink loading section, 2) handling properties, and 3) ecological requirements, the thickness of the multilayered thermoplastic film employed in the present invention is preferably 73–123 μm, but is more preferably 83–113 μm.

Employed as the multilayered thermoplastic film may be an inorganic material-evaporated film as well as an aluminum-evaporated film. Listed as inorganic material-evaporated films are those described on pages 879–901 of Hakumaku Handbook (Thin Film Handbook) published by Nihon Gakujutsu Shinko Kai; on pages 502–509, page 612, and page 810 of Shinku Gijutsu Handbook (Vacuum Technique Handbook), published by Nikkan Kogyo Shinbun Sha; and on pages 132–134 of Shinku Handbook (Vacuum Handbook), revised edition, published by ULVAC, Nihon Shinku Gijutsu K. K. For example, employed are $Cr_2O_3$, $Ta_2O_3$, ZrN, SiC, TiC, PSG, $Si_3N_4$, single crystal Si, amorphous Si, W, and $Al_2O_3$. Of these, listed as the most preferable inorganic material-evaporated film is alumina ($Al_2O_3$) film in view of strength and transparency of the resulting evaporated film. It is possible to produce inorganic material-evaporated films employing common methods described in Shinku Gijutsu Handbook (Vacuum Technique Handbook), as well as in Hoso Gijutsu (Packaging Technology) Vol. 129, No. 8, such as a resistance or high frequency induction heating method, an electron beam (EB) method, or a plasma method (PCVD). The thickness of the evaporated film is preferably in the range of 40–200 nm, but is more preferably in the range of 50–180 nm.

Employed as thermoplastic resinous films used as a substrate of the inorganic material-evaporated layer of the present invention are film materials commonly employed as packaging film composed of ethylene tetrafluoroethyl copolymers (ETFE), high density polyethylene (HDPE), biaxially oriented polypropylene (OPP), polystyrene (PS), polymethyl methacrylate (PMMA), oriented nylon 6 (ONy), polyethylene terephthalate (PET), polycarbonate (PC), polyimide, and polyether styrene (PES).

Employed as a thermoplastic resinous film used via a evaporated film sheet may be polymer films (for example, polymer film described in Kinose Hosozairyo no Shintenkai (New Development of Functional Packaging Materials), published by Toray Research Center, Limited) used as common packaging materials which are low density polyethylene (LDPE), high density polyethylene (HDPE), linear low density polyethylene (LLDPE), medium density polyethylene, non-oriented polypropylene (CPP), oriented polypropylene (OPP), oriented nylon (ONy), polyester (PET), cellophane, polyvinyl alcohol (PVA), oriented vinylon (OV), ethylene-vinyl acetate copolymers (EVOH), and polyvinylidene chloride (PVDC).

Further, if required, naturally employed as thermoplastic films may be multilayer films produced by co-extrusion with other kinds of films, as well as multilayer films which are laminated at different orientation angles. In addition, in order to realize physical properties required of packaging-materials, it is obviously possible to produce films at different combinations of the density and the molecular weight distribution of the used films. Employed as thermoplastic films of the innermost layer are produced employing low density polyethylene (LDPE), linear low density polyethylene (LLDPE), and metallocene as a catalyst, and films which are produced by mixing these films with high density polyethylene (HDPE) films. Of these, in view of melting temperature and strength, preferred is LLDPE which is produced employing a metallocene catalyst, and it is also acceptable to use those which are readily available on the market. Listed as examples are YUMERIT, produced by Ube Industries, Ltd., AFFINITY and ELITE produced by Dow Chemical Japan, HARMONICS LL, produced by Nihon Olefin Co., Ltd., CARNEL 57L produced by Nihon Polychem Co., Ltd., EVOLUE, produced by Mitsui Chemicals, Inc., RAMIRON SUPER, produced by Sekisui Film Nishi Nihon Co., Ltd., SE SERIES, produced by TAMAPOLY Co., Ltd., TOHCELLO T.U.X-FCS and T.U.X-TCS, produced by TOHCELLO Co., Ltd., TAIKO FL, produced by Nimura Chemical Industry Co., Ltd., METLOACE, produced by Mitsubishi Chemical Kojin Packs Co., Ltd., WMX produced by Wada Chemical Industry Co., Ltd., and FV202, produced by Sumitomo Chemical Co., Ltd.

In cases in which an inorganic material-evaporated layer is not employed, it is possible to use individually or in combinations, at least two kinds of film in a laminated form, while selecting any of the above thermoplastic films. For example, employed are CPP/OPP, PET/OPP/LDPE, Ny/OPP/LDPE, CPP/OPP/EVOH, SARAN UB/LLDPE (wherein SARAN UB refers to a biaxially oriented film, produced by Asahi Chemical Industry Co., Ltd.) which is prepared employing vinylidene chloride/acrylic acid ester based copolymer as raw materials K-OP/PP, K-PET/LLDPE, and K-Ny/EVA (wherein K represents a film coated with vinylidene chloride resins).

Employed as production methods of the above laminated layer films are various kinds of generally known methods described on pages 40–48 of Convertech, May 1990. It is possible to produce the above films employing, for example, a wet lamination method, a dry lamination method, a hot-melt lamination method, an extrusion lamination method, and a heat lamination method. It is also possible to produce them employing a multilayer inflation system, depending on the materials used.

Employed as adhesives for lamination may be generally known ones described on pages 18–22 of Convertech, January 1996, as well as on pages 13–17 and 21–25 of Convertech, October 1997.

Incidentally, in cases in which ink loaded in an ink loading section is an ultraviolet radiation curable type, in order to enhance light shielding function, it is preferable to apply the following materials to the ink loading section as well as to the ink feeding section. Further, it is preferable to use an aluminum evaporated film, an aluminum-foil incorporating laminated film, and further a laminated layer film having a carbon black incorporating layer. It is also preferable to use materials, which are colored by the addition of white colorants or carbon black to the above materials, in the ink feeding tube and the sealing member of the ink feeding section.

FIGS. 4(*a*) and (*b*) are enlarged schematic views of the positioning member shown in FIG. 1. FIG. 4(*a*) is an enlarged perspective view of the positioning member shown in FIG. 1, while FIG. 4(*b*) is an enlarged cross-section showing how the ink outlet section fits into the positioning member in FIG. 1.

In FIGS. 4(*a*) and 4(*b*), numeral 107*a* is a storing section into which flange members 104*a*2 and 104*a*3 of the ink outlet section are fitted. Numeral 107*b* is a cut-out section, used for the setting of ink outlet tube 104*a*1, within which flange members 104*a*2 and 104*a*3 of the ink outlet section are fitted. Numeral 107*c* is an entrance through which the ink supplying means of the inkjet recording apparatus enters the opening of ink outlet tube 104*a*1. Entrance 107*c* is formed on positioning member 107 so that the center of entrance 107*c* comes into line with the center of opening 104*a*5 of ink outlet tube 104*a*1. In the present invention, the surface having entrance 107*c* of positioning member 107 is the front surface, while the surface having the cut-out section is the rear surface. In addition, entrance 107*c* is formed on the front surface of positioning member 107 so that the center of entrance 107*c* comes into line with the center of the front surface of the positioning member.

As shown in FIG. 4(*b*), flange members 104*a*2 and 104*a*3 are stored in storing section 107*a* so that the position of the ink outlet section is determined and fixed, whereby the ink supplying section of the inkjet recording apparatus can be easily and accurately inserted into sealing-up member 104*a*7.

The positioning member can be produced via an injection molding method of the same resin material as the ink outlet section. Further, it can also be produced of a paper material, being so called "molded pulp production". In the case of a molded pulp product, the used material is not particularly limited, and for example, it is possible to use non-wood pulp made from herbaceous perennials such as reeds, and recycled newspaper, corrugated fiberboard, or waste-paper. Concerning the method of production, dissolved raw material can be molded by a molding machine, which is the general method. In addition, the positioning member mentioned above is separated from the main case, however, the positioning member can also be integrated into the main case.

Figure 5:
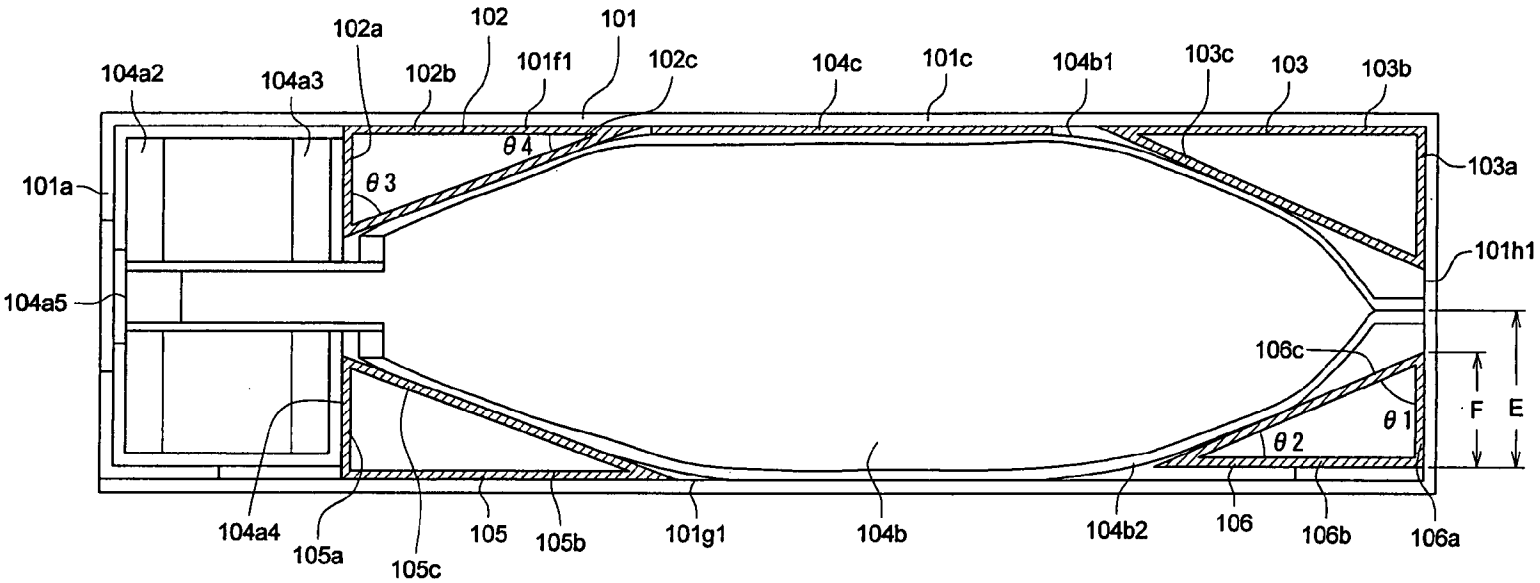
FIG. 5 is an enlarged cross-sectional view of the ink cartridge taken along line A–A' in FIG. 1.

FIG. 5 is an enlarged cross-sectional view of the ink cartridge taken along line A–A' in FIG. 1.

Explained below are the positions of first cushioning members, which are paired A-type cushioning member 102 and B-type cushioning member 103, and second cushioning members, which are paired C-type cushioning member 105 and D-type cushioning member 106. FIG. 5 shows that cushioning members A–D are located in main case 101*c* of outer case 101 (see FIG. 2).

A-type cushioning member 102 includes vertical surface X 102*a* contacting the rear surface of positioning member 107, horizontal surface Y 102*b* contacting first inner surface 101*f*1 including the longer edge of opening 101*d* (see FIG. 2) of main case 10*c* and slanted surface Z 102*c* contacting surface "a" of 104*b*1 including the shorter edge adjacent to the ink outlet section of the ink storing section 104*b*, and further the cross-section of A-type cushioning member 102 is triangular.

B-type cushioning member 103 includes vertical surface X 103*a* contacting inner surface 101*h*1 facing opening 101*d* (see FIG. 2) of main case 10*c*, horizontal surface Y 103*b* contacting first inner surface 101*f*1 including the longer edge of opening 101*d* of main case 101*c* (see FIG. 2), and slanted surface Z 103*c* contacting surface "a" of 104*b*1 including the shorter edge facing the ink outlet section of ink storing section 104*b*, and further the cross-section of B-type cushioning member 103 is triangular.

C-type cushioning member 105 includes vertical surface X 105*a* contacting the rear surface of positioning member 107, horizontal surface Y 105*b* contacting second inner surface 101*g*1 including the longer edge of opening 101*d* of main case 101*c*, and slanted surface Z 105*c* contacting surface "b" of 104*b*2 including the shorter edge adjacent to the ink outlet section of ink storing section 104*b*, and further the cross-section of C-type cushioning member 105 is triangular.

D-type cushioning member 106 includes vertical surface X 106*a* contacting inner surface 101*h*1 facing opening 101*d* of main case 10*c*, horizontal surface Y 106*b* contacting second inner surface 101*g*1 including the longer edge of opening of main case 101*c* (see FIG. 2), and slanted surface Z 106*c* contacting surface "b" of 104*b*2 including the shorter edge facing the ink outlet section of ink storing section 104*b*, and further the cross-section of D-type cushioning member 106 is triangular.

In addition, cushioning members A–D have the same cross-sections.

Angle θ1 is formed by vertical surface X 106*a* (103*a*) and slanted surface Z 106*c* (103*c*).

Angle θ2 is formed by horizontal surface Y 106*b* (103*b*) and slanted surface Z 106*c* (103*c*).

Angle θ3 is formed by vertical surface X 102*a* (105*a*) and slanted surface Z 102*c* (105*c*).

Angle θ4 is formed by horizontal surface Y 102*b* (105*b*) and slanted surface Z 102*c* (105*c*).

Angle θ1 (or θ3) is preferably 68–84°. If angle θ1 (or θ3) is less than 68°, the outer case becomes very large so that the outer case cannot be loaded into the ink cartridge mounting section of the inkjet recording apparatus. If angle θ1 (or θ3) is greater than 84°, ink storing section is pressed by the cushioning member so that when ink remaining in the ink storing section is reduced, a crease is generated on the ink storing section by the pressure of the cushioning member, whereby ink remains in the creased section, resulting in the increase of remaining ink.

Angle θ2 (or θ4) is preferably 7–22°. If angle θ2 (or θ4) is less than 7°, the ink storing section is pressed by the cushioning member so that when any ink remaining in the ink storing section is reduced, a crease is generated on the ink storing section by the pressure of the cushioning member, whereby ink remains in the creased section, resulting in the increase of remaining ink.

If angle θ2 (or θ4) is greater than 22°, the outer case is very large so that the outer case cannot be loaded into the ink cartridge mounting section of the inkjet recording apparatus.

Symbol E represents the height from second inner surface 101*g*1 of main case 101*c* to half the height of inner surface 101*h*1, while symbol F represents the height of vertical surface X 105*a* of cushioning member 106. The preferable height of F is 23–91% of height E. If it is less than 23%, ink storing section is pressed by the cushioning member so that when ink remaining in the ink storing section is reduced, a crease is generated on the ink storing section by the pressure of the cushioning member, whereby ink remains in the creased section, resulting in the increase of remaining ink. If it is greater than 91%, the girth of the ink outlet section is limited, or the ink storing section is pressed by the cushioning member so that the ink storing section cannot fit, with the desired allowance, in the outer case, whereby crash-proof is reduced, and when the outer case including the ink storing section is dropped, the ink storing section may burst. Concerning the heights of vertical surface X 102*a* of A-type cushioning member 102, vertical surface X 103*a* of B-type cushioning member 103, and vertical surface X 105*a* of C-type cushioning member 105, they are designed in the same relationship as the height of vertical surface X 106*a* of D-type cushioning member 106.

In FIG. 5, surface "a" of the ink storing section is adhered onto first inner surface 101*f*1 of main case 101*c* by double-faced adhesive tape 104*c*. When the ink cartridge shown in FIG. 5 is loaded into the inkjet recording apparatus, it is preferable that the ink outlet section is directed downward and positioned vertically, which results in the greatest desired effect of the cartridge of the present invention.

Figure 6:
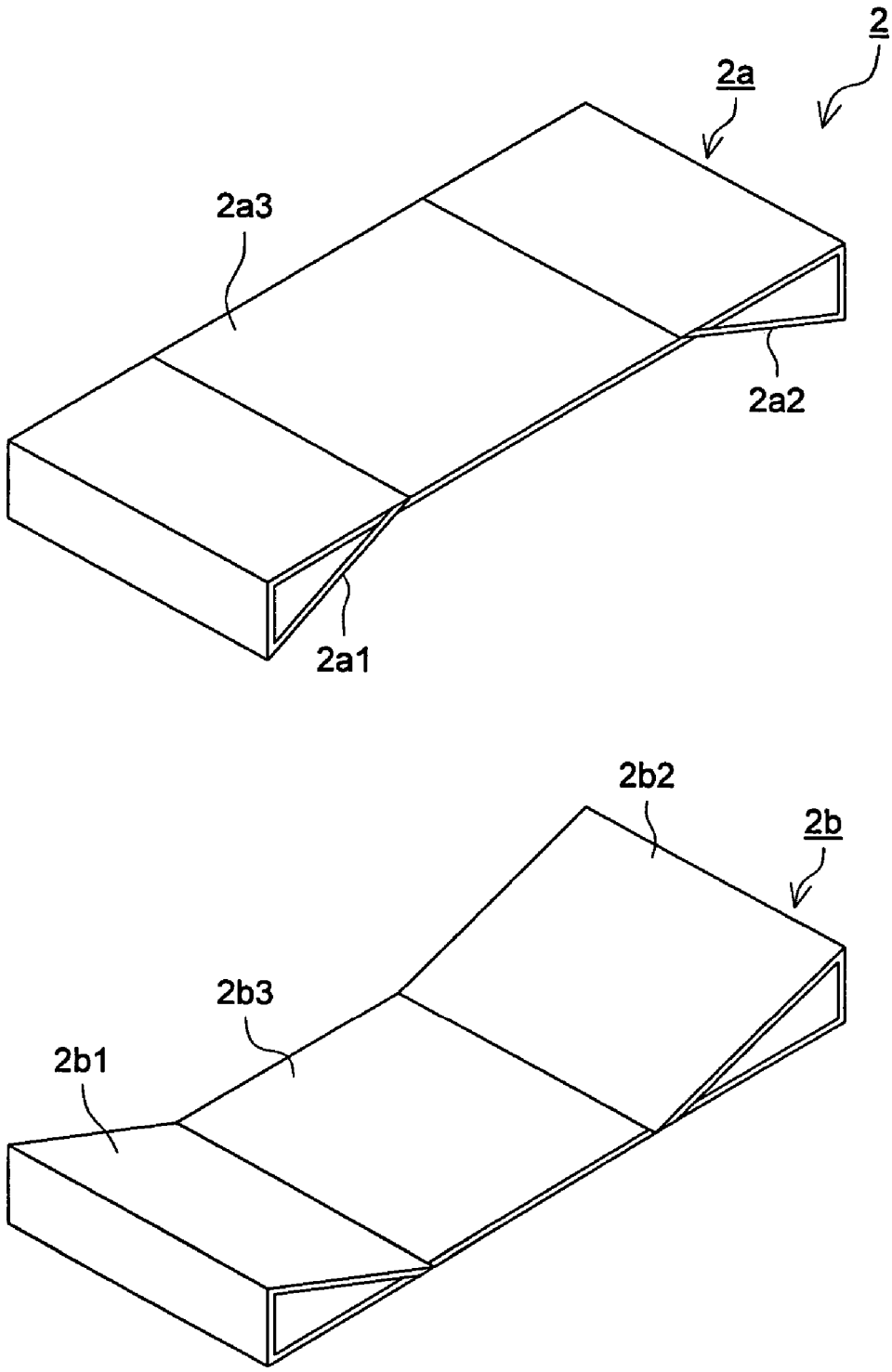
FIG. 6 is a schematic view of the cushioning members having differing shape.

FIG. 6 is a schematic view of the cushioning members having another shape.

In FIG. 6, numeral 2 shows a cushioning member, numeral 2*a* shows a first cushioning member, and numeral 2*b* shows a second cushioning member.

First cushioning member 2*a* includes cushioning section 2*a*1, exhibiting a triangular cross section (which corresponds to A-type cushioning member 102 in FIG. 5), and cushioning member 2*a*2 (which corresponds to B-type cushioning member 103 in FIG. 5 and has the same shape as it), wherein both cushioning members are united by plate 2*a*3.

Second cushioning member 2*b* includes cushioning section 2*b*1, being triangular in cross section (which corresponds to C-type cushioning member 105 in FIG. 5), and cushioning member 2*b*2 (which corresponds to D-type cushioning member 106 in FIG. 5 and has the same shape as it), wherein both cushioning members are united by plate 2*b*3.

An example for producing the cushioning member shown in FIG. 6 is that the end of a piece of sheet material which fits to the width of cushioning member 2*a*1 is folded so that cushioning member 2*a*1 is assembled, after which the other end is folded so that cushioning member 2*a*2 is assembled. It is preferable that the material used for the cushioning members in FIGS. 5 and 6 is the same as that of the outer case.

The ultraviolet hardening type ink used in the present invention is not limited to special ink, and for example, used also may be ink described in Tokukaihei 10-324836, Tokukai 2002-167537, 2002-179967, 2002-241654, 2003-147233, 2004-18716, 2004-59810, 2004-59857, 2004-124077, 2004-131589, 2004-131725, and 2004-182933.

The shapes of the cushioning members relating to the present invention shown in FIGS. 1–6 are triangular in cross-section, which however are not limited to a triangle. For example, an elastic member, including pressurized gas can be used. Additionally, for example, the cushioning members can be included into a main case made of soft material and shaped to be a cushion such as an accordion surface.

To use the cartridge of the present invention shown in FIGS. 1–6 will result in the effects described below.

(1) The ink package is prevented to move in the ink cartridge by the cushioning members so that the ink package becomes very stable against vibration or dropping during transportation or handling, and thereby the ink storing section can be protected from damage, so that transportation or handling is performed with ease and assurance.

(2) When the ink outlet section is inserted into the positioning member, its position is secured, so that the ink cartridge can be easily loaded into the ink supplying section of the inkjet recording apparatus.

(3) When the ink cartridge is vertical and loaded into the ink supplying section of the inkjet recording apparatus, the slanted surface of the cushioning member functions as a funnel, and during the operation, even when ink in the ink storing section is reduced, ink is smoothly supplied to the inkjet recording apparatus, and the amount of ink which will not be used by the inkjet recording apparatus becomes very small.

(4) The ink cartridge is vertical and loaded into the ink supplying section of the inkjet recording apparatus, and since one of the surfaces of the ink storing section is fixed onto the inner surface of the main case of the outer case, even when ink in the ink storing section is reduced, the ink storing section does not move toward the ink outlet section nor deform during the operation, and thereby remaining ink can be supplied to the apparatus, resulting in reduction of remaining ink.

(5) Since the parts structuring the ink cartridge can be dismounted, the used parts can be fractionally recovered, which greatly improve the recycling efficiency.

The effects of this invention will now be detailed referring to the examples, however the effects are not limited to the examples.

EXAMPLE 1

The ink cartridge was produced of the following materials.

(Production of the Ink Package)

The ink package is produced of a multi-layer thermoplastic film in which PET of 12 μm, aluminum foil of 9 μm, ONy of 15 μm, LLDPE of 20 μm, and black LLDPE of 50 μm are multi-layered, and the ink package is formed to be a tube by a center sealing method. The connecting member of the ink outlet section shown in FIG. 3, which is made from LDPE via an injection molding method, is inserted into one end of the openings of the tube and adhered via a heat welding method. After ink is filled into the tube under reduced pressure, then the other end is sealed via said heat welding method to form the ink package shown in FIG. 3.

Concerning the overall size of the ink storing section of the produced ink package, the length of shorter edge is 245 mm, the length of the longer edge is 570 mm, and the volume is 4,000 ml. The inside diameter of the ink outlet tube of the ink outlet section is 2.2 mm, while the outer diameter is 2.8 mm. The diameter of the flange members is 33 mm, and their thickness is 3 mm, and the distance between the two flanges is 30 mm. Rigidity of the multi-layer thermo plastic film is $1.3\times10^{-6}$ $Nm^2$, measured via Tensile Tester PSC-100 produced of Shimadzu Corporation.

(Production of the Outer Case)

The outer case shown in the expansion plan of FIG. 2(*c*) was produced from paper board, at a basic weight of 450 $g/m^2$, and a thickness of 590 μm. The width of the opening is 250 mm, and the height is 70 mm.

(Production of the Positioning Member)

The positioning member shown in FIG. 4 was produced of corrugated fiberboard via a pulp molding method. The size of the storing section of the positioning member is determined in such a way that the two flange members mounted onto the ink outlet section can be secured, and the cut-off section into which the ink outlet tube is inserted is adjusted to the diameter of the ink outlet tube. The width and height of the positioning member is adjusted to the size of the opening of the outer case.

(Production of the Cushioning Members)

The first cushioning member shown in FIG. 6 was produced from the same paper board as the outer case, wherein the shape of the cushioning section is changed as shown in Table 1, which are represented by 1-1 to 1-10 in Table 1. In addition, the second cushioning member was designed to be the same shape as the first cushioning member. Further, surface X represents the surface which contacts the rear surface of the positioning member (or the surface which contacts the inner surface facing the opening of the main case). Surface Y represents the surface which contacts first inner surface (or second inner surface) including the longer edge of the opening of the main case. Surface Z represents the slanted surface which contacts surface "a" (or "b") including the shorter edge of the ink storing section. In Table 1, height ratio of surface X means F/E×100% (see FIG. 5), wherein F is height of surface X, and E is half the inner surface facing the opening of the main case, based on the second surface of the main case, that is E is 35 mm.

TABLE 1

| Cushioning member No. | Angle formed by surface X and surface Z (°) | Angle formed by surface Y and surface Z (°) | Height ratio of surface X, F/35 × 100% |
|---|---|---|---|
| 1-1 | 67 | 23 | 71 |
| 1-2 | 68 | 22 | 71 |
| 1-3 | 69 | 21 | 71 |
| 1-4 | 72 | 18 | 71 |
| 1-5 | 75 | 15 | 71 |
| 1-6 | 78 | 12 | 71 |
| 1-7 | 81 | 9 | 71 |
| 1-8 | 83 | 7 | 71 |
| 1-9 | 84 | 6 | 71 |
| 1-10 | 76 | 14 | 22 |
| 1-11 | 76 | 14 | 23 |
| 1-12 | 76 | 14 | 25 |
| 1-13 | 76 | 14 | 30 |
| 1-14 | 76 | 14 | 50 |
| 1-15 | 76 | 14 | 70 |
| 1-16 | 76 | 14 | 91 |
| 1-17 | 76 | 14 | 92 |
| 1-18 | 67 | 23 | 22 |
| 1-19 | 68 | 22 | 23 |
| 1-20 | 69 | 21 | 25 |
| 1-21 | 72 | 18 | 30 |
| 1-22 | 75 | 15 | 50 |
| 1-23 | 78 | 12 | 70 |
| 1-24 | 81 | 9 | 90 |
| 1-25 | 83 | 7 | 91 |
| 1-26 | 84 | 6 | 92 |

(Production of the Ink Cartridge)

The produced ink outlet section of the ink package was mounted into the storing section of the positioning member, and produced cushioning members 1—1 to 1–26 were fitted into the outer case in the manner shown in FIG. 5, which were represented by samples 101–126 in Table 2.

Concerning samples 101–126, the vibration tolerance and the volume of remaining ink were tested and measured by the following test method, and each sample was evaluated by the following evaluation rankings, the evaluation results of which are shown in Table 2.

The vibration tolerance test was conducted for six cycles via vibration tester BF-UA of IDEX corporation, wherein the vibration frequency was changed from 5 to 64 Hz within five minutes for one cycle, then the outer case of the ink cartridge was opened to visually check damage to the ink storing section.

The evaluation rankings

A: No damage on the ink storing section;

B: Scratches were found, but no ink leakage resulted in the ink storing section;

C: Ink leakage resulted in the ink storing section.

The amount of remaining ink was checked via the following method.

The ink cartridge was loaded onto Konica inkjet recording apparatus LF-900, produced of Konica Co. Ltd. Recording was repeated by the apparatus until the recorded sheet could not be read, after that the remaining ink was measured. The amount of remaining ink was obtained by the following formula.

Amount of the remaining ink=weight of a new ink. cartridge−weight of completely empty ink cartridge.

TABLE 2

| Sample No. | Cushioning member No. | Vibration tolerance | Remaining ink (ml) |
|---|---|---|---|
| 101 | 1-1 | B | 60 |
| 102 | 1-2 | A | 30 |
| 103 | 1-3 | A | 30 |
| 104 | 1-4 | A | 20 |
| 105 | 1-5 | A | 20 |
| 106 | 1-6 | A | 15 |
| 107 | 1-7 | A | 15 |
| 108 | 1-8 | A | 10 |
| 109 | 1-9 | B | 10 |
| 110 | 1-10 | B | 50 |
| 111 | 1-11 | A | 40 |
| 112 | 1-12 | A | 30 |
| 113 | 1-13 | A | 20 |
| 114 | 1-14 | A | 10 |
| 115 | 1-15 | A | 10 |
| 116 | 1-16 | A | 60 |
| 117 | 1-17 | B | 70 |
| 118 | 1-18 | B | 10 |
| 119 | 1-19 | A | 10 |
| 120 | 1-20 | A | 10 |
| 121 | 1-21 | A | 10 |
| 122 | 1-22 | A | 10 |
| 123 | 1-23 | A | 10 |
| 124 | 1-24 | A | 80 |
| 125 | 1-25 | A | 90 |
| 126 | 1-26 | B | 100 |

In order to check the remaining ink, 26 ink cartridges were loaded into inkjet recording apparatus Lf-900. Loading was easily conducted because the position of the ink outlet section was limited to the same position by the positioning member. That is, the effectiveness of loading of the present invention was recognized.

EXAMPLE 2

The ink cartridges were produced under changed condition of rigidity of the multi-layer thermoplastic film material of the ink package shown in sample No. 1-5 of Table 1, which are shown as sample Nos. 201–208 of Table 3, and the other conditions are the same as the conditions of Example 1. In order to change rigidity, the thickness of black LLDPE as the sealing layer was varied, when the multi-layer thermo plastic film materials were produced, in which superimposed were PET of 12 μm, aluminum foil of 9 μm, ONy of 15 μm, LLDPE of 20 μm, and black LLDPE of 50 μm. In addition, rigidity was measured via Tensile Tester PSC-100 produced by Shimadzu Corporation.

The samples represented by Nos. 201–208 in table 3 were tested in the same manner as Example 1, and evaluated under the same evaluation rankings. The rigidity represents the rigidity of the multi-layer thermoplastic film material of the ink package.

TABLE 3

| Sample No. | Rigidity ($Nm^2$) | Tolerance of vibration | Amount of remaining ink (ml) |
|---|---|---|---|
| 201 | $7.8 \times 10^{-7}$ | B | 20 |
| 202 | $7.9 \times 10^{-7}$ | A | 20 |
| 203 | $8.5 \times 10^{-7}$ | A | 20 |
| 204 | $9.5 \times 10^{-7}$ | A | 20 |
| 205 | $1.0 \times 10^{-6}$ | A | 20 |
| 206 | $1.3 \times 10^{-6}$ | A | 20 |
| 207 | $1.5 \times 10^{-6}$ | A | 35 |
| 208 | $1.7 \times 10^{-6}$ | A | 35 |
| 209 | $1.9 \times 10^{-6}$ | A | 35 |
| 210 | $2.0 \times 10^{-6}$ | B | 50 |

The effectiveness of the present invention was apparent as follows.

The ink cartridge of the present invention can be easily loaded into or removed from the inkjet recording apparatus, is resistant against dropping during transportation or handling, and is also resistant against vibration during transportation. Further, the inkjet recording apparatus can use the ink cartridge incorporating a bag-type ink container with an integral ink outlet section, and the ink storing section which feeds all but minimized residual ink, whereby the apparatus can decrease the overall cost of inked recordings.

What is claimed is:

1. A disposable ink cartridge used in an inkjet recording apparatus, comprising:

an ink rack having an ink storing section and an ink outlet section;

an outer case which is air permeable and demountable and contains the ink pack;

a positioning member which is removable and secures the ink outlet section in the outer case;

a cushioning member which is demountable and supports the ink storing section in the outer case; and a securing member which is adhesive and secures at least a part of the ink storing section onto an inner surface of the outer case.

2. The disposable ink cartridge in claim 1, wherein the cushioning member includes a first cushioning member and a second cushioning member.

3. The disposable ink cartridge in claim 2, wherein the first cushioning member includes an outlet side cushioning member which supports a portion of the ink storing section in adjacent to the ink outlet section, and an opposite side cushioning member which supports a portion of the ink storing section opposite to the ink outlet section.

4. The disposable ink cartridge in claim 3, wherein the outlet side cushioning member and the opposite side cushioning member of the first cushioning member are connected by a flat plate.

5. The disposable ink cartridge in claim 3, wherein the outlet side cushioning member and the opposite side cushioning member of the first cushioning member are independent of each other.

6. The disposable ink cartridge in claim 3, wherein a cross section of the outlet side cushioning member of the first cushioning member is triangular, having an angle between 68–84° to support a top of the ink storing section and an angle between 7–22 to support a center of the ink storing section.

7. The disposable ink cartridge in claim 3, wherein a cross section of the opposite side cushioning member is triangular, having an angle between 68–84° to support an end of the ink storing section, and an angle between 7–22° to support a center of the ink storing section.

8. The disposable ink cartridge in claim 2, wherein the second cushioning member includes an outlet side cushioning member which supports a portion of the ink storing section in adjacent to the ink outlet section, and an opposite side cushioning member which supports a portion of the ink storing section opposite to the ink outlet section.

9. The disposable ink cartridge in claim 8, wherein the outlet side cushioning member and the opposite side cushioning member of the second cushioning member are connected by a flat plate.

10. The disposable ink cartridge in claim 8, wherein the outlet side cushioning member and the opposite side cushioning member of the second cushioning member are independent of each other.

11. The disposable ink cartridge in claim 1, wherein the ink storing section is formed of a multi-layer thermoplastic film material.

12. The disposable ink cartridge in claim 11, wherein rigidity of the multi-layer thermoplastic film material is $9.7\times10^{-7}$–$9\times10^{-6}Nm^2$.

13. The disposable ink cartridge in claim 1, further the outer case includes a lid attached on the casing section, wherein the lid includes a cut-out section at a position corresponding to the ink outlet section.

14. The disposable ink cartridge in claim 1, wherein an ink stored in the ink storing section is an ultraviolet hardening type ink.

15. The disposable ink cartridge in claim 1, wherein the outer case is formed of a paper material.

16. The disposable ink cartridge in claim 1, wherein the outer case is formed of a resin material.

17. The disposable ink cartridge in claim 1, wherein the ink storing section is a multi-layer structure in which the thermo plastic resin film and a light shielding member are stacked.

18. The disposable ink cartridge in claim 1, wherein the ink cartridge is loaded into an inkjet recording apparatus.

19. The disposable ink cartridge in claim 1, wherein when the ink cartridge is loaded, the ink cartridge is directed vertically in such a manner that the ink storing section is directed downward in the inkjet recording apparatus.

* * * * *